US005797502A

United States Patent [19]

Brady et al.

[11] Patent Number: 5,797,502

[45] Date of Patent: Aug. 25, 1998

[54] UNIVERSAL, HEIGHT-ADJUSTABLE HANGER BRACKET

[75] Inventors: Timothy D. Brady, Ventura, Calif.; Brian F. Russell, Georgetown, Ky.; Michael P. Kelly, Oreland, Pa.

[73] Assignee: Western Pacific Storage Systems, Inc., Georgetown, Ky.

[21] Appl. No.: 728,816

[22] Filed: Oct. 10, 1996

[51] Int. Cl.[6] ..... A47H 1/00

[52] U.S. Cl. ..... 211/183; 211/187; 108/107

[58] Field of Search ..... 211/151, 187, 211/191, 59.2, 183; 108/106, 107, 144; 208/243, 270.31

[56] References Cited

U.S. PATENT DOCUMENTS

| | | | |
|---|---|---|---|
| 2,261,956 | 11/1941 | Brownlie et al. . | |
| 2,719,633 | 10/1955 | Rosenberg . | |
| 3,136,520 | 6/1964 | Reiss . | |
| 3,759,297 | 9/1973 | Anderson et al. . | |
| 3,846,944 | 11/1974 | Lambert . | |
| 3,900,112 | 8/1975 | Azzi et al. | 211/151 X |
| 4,154,419 | 5/1979 | Breidenbach . | |
| 4,405,052 | 9/1983 | Spiros | 211/59.2 X |
| 4,453,641 | 6/1984 | Rasmussen et al. | 211/151 X |
| 4,513,669 | 4/1985 | Steinke . | |
| 4,515,494 | 5/1985 | Robilliard et al. | 211/187 X |
| 4,872,567 | 10/1989 | Bustos | 211/59.2 |
| 5,115,920 | 5/1992 | Tipton et al. | 211/59.2 |
| 5,199,585 | 4/1993 | Schafer . | |
| 5,205,421 | 4/1993 | Bustos . | |

*Primary Examiner*—Jose V. Chen
*Attorney, Agent, or Firm*—King and Schickli

[57] ABSTRACT

A universal, height-adjustable bracket is provided for mounting a gravity flow rack product delivery system to an upright post of a support framework. The bracket includes an elongated body having first and second sets of fastening tabs projecting from opposite sidewalls thereof. The first and second set of fastening tabs are longitudinally offset from one another in order to provide relative height adjustability. A channel for engaging and supporting the gravity flow rack system extends transversely across the elongated body between the first and second sidewalls and sets of fastening tabs. Accordingly, by rotating the bracket 180° about the longitudinal axis, the bracket may be used to cooperatively engage either right or left handed upright posts.

5 Claims, 2 Drawing Sheets

Fig. 1
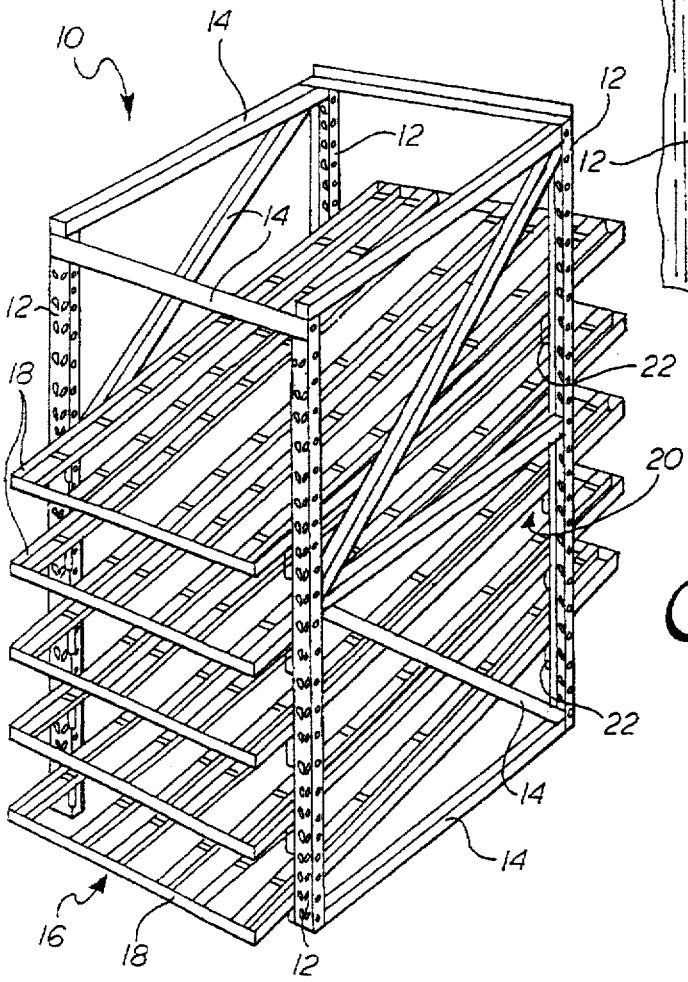
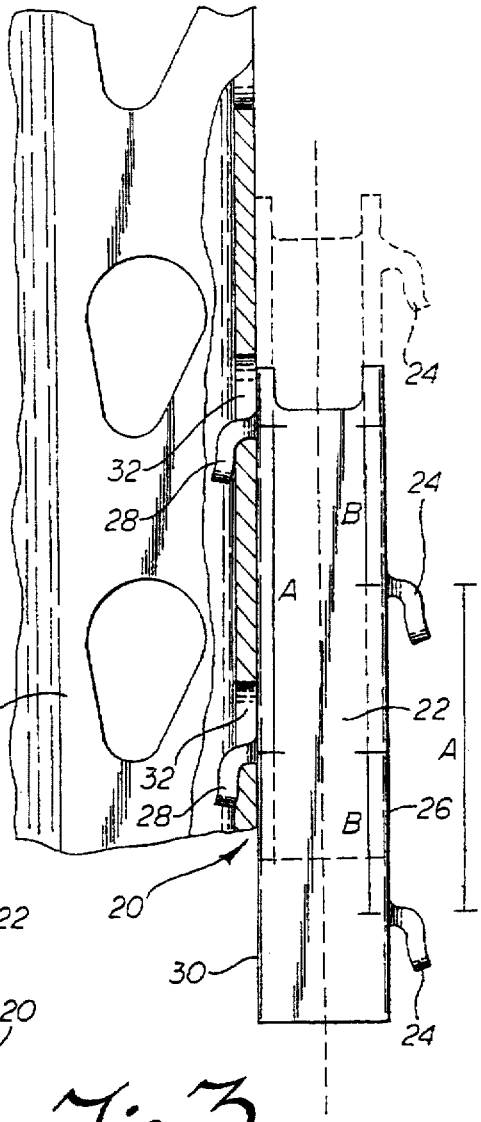
Fig. 3

UNIVERSAL, HEIGHT-ADJUSTABLE HANGER BRACKET

TECHNICAL FIELD

The present invention relates generally to the field of display and merchandising racks and, more particularly, to a universal and height-adjustable bracket for mounting a gravity flow rack system to an upright post of a support framework.

BACKGROUND OF THE INVENTION

Gravity flow rack or order picking systems in which merchandise cartons are placed at the rear of downwardly inclined shelves for sliding movement of the cartons toward the front of the shelves are well shown in the art. The downwardly inclined shelves of each gravity flow rack systems generally comprise rectangular frames having roller track members and guide track members extending between front and rear shelf frame rails. A particularly commercially successful gravity flow rack system of the type being described is disclosed in, for example, U.S. Pat. No. 4,394,910 to Miller.

The present invention relates to a novel and unique bracket for securing a gravity flow rack system of the type described in the Miller patent to various support frameworks produced by a number of different manufacturers. Such support frameworks typically include upright posts having a series of spaced apertures for receiving the brackets and a series of cooperating connecting members to provide rigidity.

SUMMARY OF THE INVENTION

Accordingly, it is a primary object of the present invention to provide a bracket of relatively simple and inexpensive construction for mounting a gravity flow rack system to an upright post of a support framework.

Another object of the present invention is to provide such a bracket that is capable of universal mounting to both left and right handed upright posts while also providing added height adjustability. Accordingly, an extremely versatile bracket is provided that may effectively secure the gravity flow rack system to an upright post as manufactured by a number of producers of support frameworks.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a universal, height-adjustable bracket is provided for mounting a gravity flow rack system such as the Rolla-Trak gravity flow system manufactured and sold by Western Pacific Storage Systems, Inc. to an upright post of a support framework. The bracket comprises an elongated body defining a longitudinal axis and includes first and second sets of fastening tabs. The first set of fastening tabs projects outwardly from a first side of the elongated body in a direction perpendicular to the longitudinal axis. The second set of fastening tabs projects outwardly from a second, opposite side of the elongated body in a second opposite direction that is also perpendicular to the longitudinal axis.

As will be appreciated from the following description, the first and second set of fastening tabs may be utilized to selectively engage cooperating apertures formed in the upright post to which the bracket is secured.

Preferably, the first and second set of fastening tabs are offset from one another along the longitudinal axis of the elongated body. More specifically, it is preferred that the individual fastening tabs of both the first and second sets are spaced apart a distance A along the longitudinal axis while the first and second set of tabs are also offset a distance B from one another along the longitudinal axis where $B=\frac{1}{2}(A)$.

In addition, the universal, height-adjustable bracket also includes a channel at one end for engaging and supporting the gravity flow rack system to be mounted to the upright post. More specifically, the channel extends transversely across the elongated body between the first and second sidewalls and sets of fastening tabs.

This structural arrangement and geometry provides a number of unique features and benefits heretofore unavailable with other mounting brackets known in the art. More specifically, it should be appreciated that each of the first and second sets include at least two individual tabs. Accordingly, each tab set provides at least two-point mounting for extra stability. Further, it should be appreciated that the bracket may be reversed by rotating 180° about the longitudinal axis thereof. Accordingly, the bracket allows effective mounting to either a right or left handed upright post and is thus installation friendly.

Additionally, it should be appreciated that either set of fastening tabs may be utilized to secure the bracket to an upright post. Since the fastening tab sets are offset, this enhances the height adjustability of the bracket thereby allowing one to provide relatively fine adjustment of the inclination of the gravity flow rack system and insure proper feeding of merchandise cartons.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all with out departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the invention. In the drawing:

FIG. 1 is a perspective view of a gravity flow rack system secured to the upright posts of a support framework by means of the bracket of the present invention;

FIG. 3 is a detailed partially sectional view showing the connection between the bracket of the present invention and an upright post;

Reference will now be made in detail to the present preferred embodiment of the invention, an example of which is illustrated in the accompanying drawing.

DETAILED DESCRIPTION OF THE INVENTION

Figure 2:
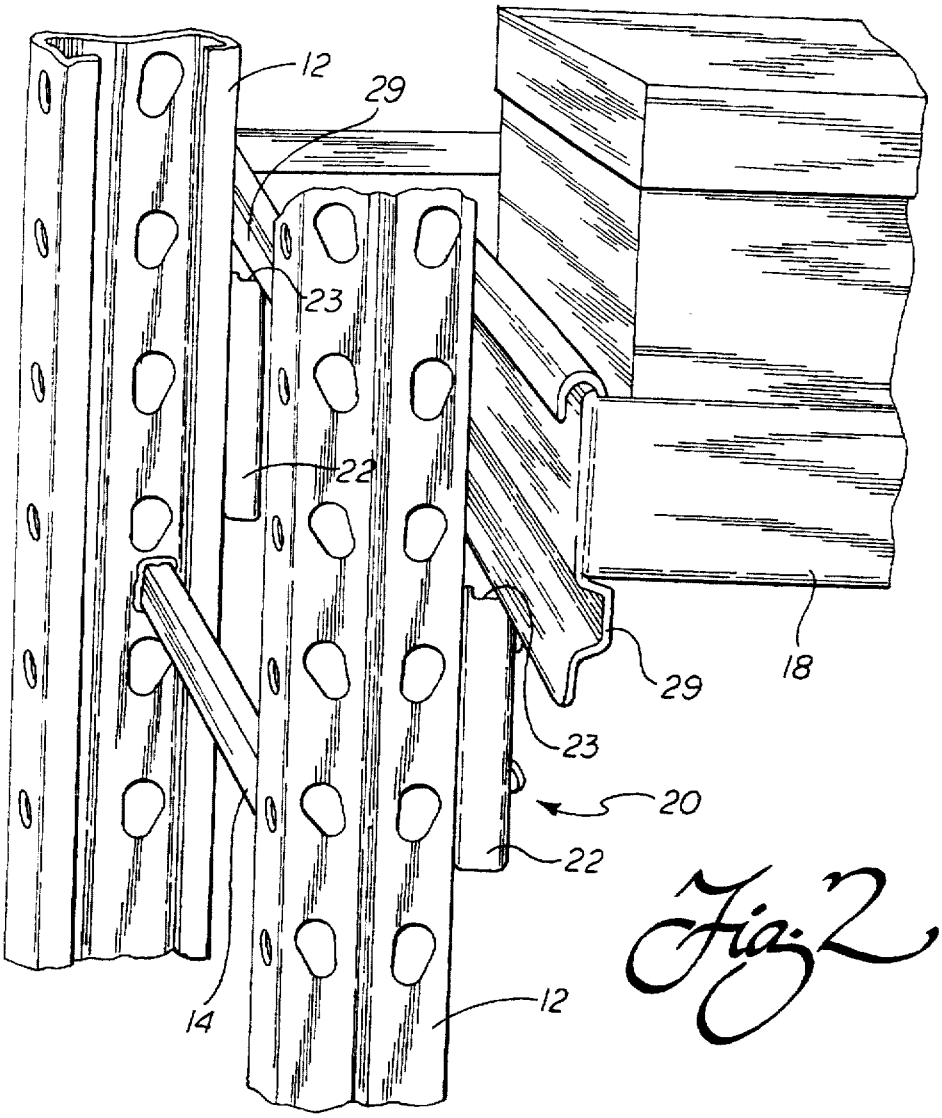
FIG. 2 is a partial perspective view showing two universal, height-adjustable brackets of the present invention secured to two upright post of a support framework and holding a gravity flow rack system.

FIG. 1 shows a cubical support framework 10 having four spaced vertical or upright posts 12 and connecting members 14 that function to support and carry a gravity flow rack system 16 shown as five shelves 18. The shelves 18 of the gravity flow rack system 16 are of the type well known in the art and fully disclosed in the assignee's U.S. Pat. No. 4,394,910. As best shown in FIG. 2, each of the shelves 18 of the gravity flow rack system 16 are secured to the upright post 12 by means of a universal, height-adjustable bracket 20. Preferably, the bracket 20 is formed from 12 gauge steel so as to provide a weight supporting capacity of at least 1050 lbs.

Figure 4:
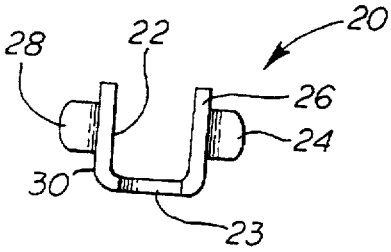
FIG. 4 is a top plan view of the bracket.

As best shown in FIGS. 2, 3 and 4, each bracket 20 includes an elongated body 22 defining a longitudinal axis L. Each bracket 20 also is substantially U-shaped in cross-section although it should be appreciated that other shapes could be utilized. A channel 23 at the top end of each bracket 20 extends between the sidewalls 26 and 30. As best shown in FIG. 2, this channel 23 functions to receive and engage the side frame rail 29 of a shelf 18 of the gravity flow rack system 16.

A first set of integral fastening tabs 24 project from the first sidewall 26 of the elongated body 22 while a second set of integral fastening tabs 28 project from the second, opposite sidewall 30 of the elongated body. Each of the fastening tabs 24, 28 is preferably substantially 0.3125 inches wide and substantially 0.450 inches long and defines a gap between the associated sidewall 26 or 30 and the inner wall of the tab of substantially 1.20 inches.

Figure 5:
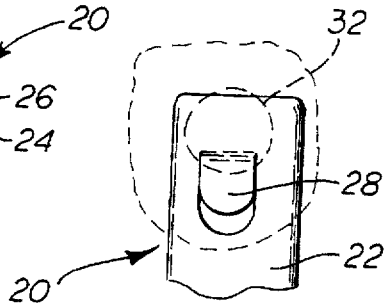
FIGS. 5 and 6 are respective detailed side elevational views showing the connection of a fastening tab of the bracket of the present invention in a round and square aperture formed in the upright post of the support framework.
Figure 6:
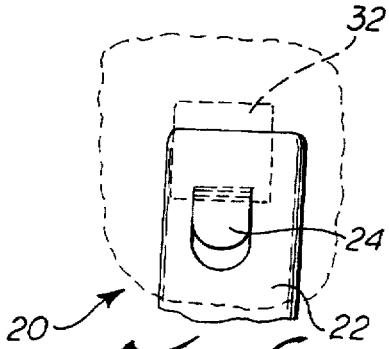

Because of the design of the tabs 24, 28, the bracket 20 may be effectively and securely connected in a number of different shaped apertures. Thus, not only may the bracket 20 be secured in round apertures as shown in FIGS. 2, 3 and 5 but also square apertures as shown in FIG. 6 as well as other shapes (e.g. trapezoidal, ovoid) not shown. This is true whether the upright post 12 is constructed from either of the more commonly employed 12 or 14 gauge material. The only necessity is that the aperture provide a clearance of at least 0.375 inches. Accordingly, it should be appreciated that the bracket 20 may be secured to upright posts 12 of a number of designs produced by a number of different manufacturers. Additionally, it should be appreciated that secure engagement is achieved without the utilization of separate nuts, bolts or any other clip or holding accessory. Thus, the installation procedures is one of "snap-in" convenience.

In addition, it should be appreciated that bracket 20 may be rotated 180° about the longitudinal axis L. This reverses the bracket 20 and thereby allows the bracket to be engaged in either right handed or left handed posts. Advantageously, this eliminates any need to maintain separate parts inventories of right and left handed brackets: a troublesome and relatively expensive practice associated with prior art bracket designs.

In accordance with yet another aspect of the present invention, it should be appreciated that the first and second set of fastening tabs 24, 28 are offset from one another along the longitudinal axis L. Specifically, the individual fastening tabs 24, 28 of both the first and second sets are spaced apart a distance A along the longitudinal axis L while the first and second set of tabs are offset at distance B from one another along that same axis where B=½(A). Thus, where the individual tabs 24, 26 of each set are spaced apart 2 inches, the individual tabs of the two sets are offset 1 inch from one another. Where the individual tabs of each set are spaced apart 3 inches, the individual tabs of the two sets are offset 1.5 inches from one another. Accordingly, it should be appreciated that by selectively engaging the apertures 32 in an upright post 12 with either of the two sets of tabs 24, 28, vertical spacing may be adjusted by ½ the center hole to center hole spacing distance of the individual tabs of each set. This allows a more fine adjustment of shelf height and inclination which allows the shelves 18 of the gravity flow rack system 16 to be better customized to handle certain merchandise cartons and meet user needs.

It should also be appreciated that the bracket 20 of the present invention is particularly useful in retrofitting a gravity flow rack system to an existing framework 10. This is primarily due to the unique versatility provided by the design of the bracket 20 that makes the bracket essentially universal and adaptable to fit an upright post of substantially any manufacturer where that post incorporates spaced apertures.

Specifically, the spacing of the apertures 32 in the existing upright post 12 is initially measured. Typically, the apertures are spaced on two or three inch centers. A bracket 20 is selected by matching the spacing of the tabs in each tab set 24, 28 with the spacing between the post apertures 32. The bracket 20 is then manipulated in order to insert the tabs of one set 24, 28 in the desired apertures 32 in the post 12. Of course, initial height adjustment is provided by the selection of the apertures 32 to be engaged with the tabs 24 or 28. Fine height adjustment is provided by reversing the bracket 20 (i.e. rotating it 180° about the longitudinal axis L) and inserting the second, offset set of fastening tabs 24 or 28 in the same apertures 32 (note phantom line showing of bracket in FIG. 3). Since the offset is equal to ½ of the spacing of the tabs of the individual tabs sets 24, 28, this allows a relatively finer adjustment so that the shelf spacing and incline of the shelf 18 of the gravity flow rack system 16 may be better adjusted to provide the desired forward feeding action of the merchandise carton C.

After inserting the desired fastening tabs 24, 28 of a bracket 20 into each of the upright posts 12 of the framework 10, one bracket is secured to each post in a position to hold a shelf 18 at the desired height and inclination. The shelf 18 is then secured to the brackets 20 by engaging the side frame rails 29 in the channels 23 at the top end of the brackets 20 (see FIG. 2). This completes a relatively simple and fastenerless connection in a relatively short installation time.

In summary, numerous benefits result from employing the concepts of the present invention. The bracket 20 of the present invention is essentially universal allowing easy and convenient "fastenerless" attachment to an upright post as produced by a number of different manufacturers. Advantageously, the bracket 20 is freely reversible and, accordingly, may be connected to either a right handed or left handed upright posts 12. Further, by selecting either set of tabs 24, 28 for engagement in the apertures 32 of the post 12, it is possible to provide a more fine adjustment so that the most desired shelf spacing and inclination may be provided to the gravity flow rack system 16 secured to the framework 10 by the bracket.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

We claim:

1. A universal, height-adjustable bracket for mounting a gravity flow rack system to an upright post of a support framework, comprising:

an elongated body defining a longitudinal axis;

a first set of at least two fastening tabs projecting outwardly from said longitudinal axis in a first direction from a first sidewall of said elongated body for selectively engaging in cooperating apertures formed in the upright post; and a second set of at least two fastening tabs projecting outwardly from said longitudinal axis in a second different direction from a second sidewall of said elongated body for selectively engaging in the cooperating apertures formed in the upright post, said first and second set of at least two fastening tabs being offset from one another along said longitudinal axis so that either of said first and second sets of at least two fastening tabs may be fastened in the apertures in the upright post in order to provide height adjustment.

2. The universal, height-adjustable bracket set forth in claim 1, wherein said elongated body is substantially U-shaped in cross-section.

3. The universal, height-adjustable bracket set forth in claim 1, wherein an end of said elongated body includes a channel for engaging and supporting the gravity flow rack system.

4. The universal, height-adjustable bracket set forth in claim 3, wherein said channel extends across said elongated body between said first and second set of at least two fastening tabs.

5. The universal, height-adjustable bracket set forth in claim 1, wherein each tab of said first set of at least two fastening tabs is spaced apart a distance A along said longitudinal axis, each tab of said second set of at least two fastening tabs is spaced apart a distance A along said longitudinal axis and said offset of said first set of at least two fastening tabs from said second set of at least two fastening tabs is a distance B along said longitudinal axis where B=½A.

* * * * *